US010286676B2

(12) United States Patent
Kimura et al.

(10) Patent No.: US 10,286,676 B2
(45) Date of Patent: May 14, 2019

(54) RECORDING APPARATUS

(71) Applicant: SEIKO EPSON CORPORATION, Tokyo (JP)

(72) Inventors: Naomi Kimura, Okaya (JP); Shoma Kudo, Shiojiri (JP); Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,815

(22) Filed: Mar. 12, 2018

(65) Prior Publication Data

US 2018/0272731 A1 Sep. 27, 2018

(30) Foreign Application Priority Data

Mar. 27, 2017 (JP) ..... 2017-061399

(51) Int. Cl.
*B41J 2/175* (2006.01)
*B41J 29/13* (2006.01)

(52) U.S. Cl.
CPC ..... *B41J 2/17566* (2013.01); *B41J 2/17509* (2013.01); *B41J 29/13* (2013.01); *B41J 2002/17573* (2013.01)

(58) Field of Classification Search
CPC ..... B41J 2/17566; B41J 2002/17573
See application file for complete search history.

(56) References Cited

U.S. PATENT DOCUMENTS 6,338,539 B1 * 1/2002 Kobayashi ..... B41J 2/16532 347/108
2004/0001128 A1 * 1/2004 Hung ..... B41J 2/17513 347/86
2015/0284170 A1 10/2015 Igarashi et al.
2017/0120643 A1 5/2017 Igarashi et al.

FOREIGN PATENT DOCUMENTS

JP 2006-224433 A 8/2006
JP 2015-199261 A 11/2015

* cited by examiner

*Primary Examiner* — Geoffrey S Mruk
(74) *Attorney, Agent, or Firm* — Workman Nydegger

(57) ABSTRACT

A recording apparatus includes: a recording head that performs recording; a carriage that has a recording head on the bottom and is movable in a width direction intersecting a medium transport direction; at least one ink tank loaded on the carriage, above the recording head, the ink tank storing ink to be supplied to the recording head and having a filling port from which ink can be poured from a refilling container. The ink tank has, at least in one portion thereof, a level checking portion formed of a transparent material through which the liquid level in the liquid container can be viewed. The carriage has a first viewing portion through which the level checking portion of the ink tank can be viewed.

13 Claims, 8 Drawing Sheets

RECORDING APPARATUS

BACKGROUND

1. Technical Field

The present invention relates to recording apparatuses that perform recording on media.

2. Related Art

Ink jet printers, serving as an example of recording apparatuses, have recording heads that perform recording by discharging ink on sheets, serving as media, and liquid containers that store ink to be supplied to the recording heads. In some ink jet printers, the liquid containers can be refilled with ink consumed by recording (for example, see JP-A-2015-199261 and JP-A-2006-224433).

In a multifunction printer 10 disclosed in JP-A-2015-199261, a printer unit 11 has a refillable ink tank 100 (corresponding to a liquid container) on the front side of a housing (i.e., on the front right side in FIG. 1A of JP-A-2015-199261). Ink is supplied through ink tubes 32B, 32M, 32C, and 32Y from the ink tank 100 to a recording head 39 loaded on a movable carriage (see FIG. 3 of JP-A-2015-199261).

JP-A-2006-224433 discloses an ink jet recording apparatus having an on-carriage refillable ink tank (i.e., an ink jet recording cartridge 111 in JP-A-2006-224433), which is loaded on a carriage.

When the ink tank 100 is configured to be viewable from the outside, as in JP-A-2015-199261, for example, a transparent window is provided in at least a portion of the ink tank so that the ink level in the ink tank can be viewed from the outside. Thus, a user can easily determine the timing of refilling the ink tank.

However, the ease of viewing the ink level in on-carriage ink tanks, such as those disclosed in JP-A-2006-224433, from the outside of the recording apparatuses has never been considered.

SUMMARY

An advantage of some aspects of the invention is that it provides a recording apparatus having a refillable ink tank that is loaded on a movable carriage having a recording head. The ink level in the ink tank can be easily checked from the outside of the recording apparatus.

A recording apparatus according to a first aspect of the invention includes a recording unit that discharges liquid on a medium to perform recording; a carriage that has the recording unit on the bottom and is movable in a width direction intersecting a medium transport direction; and at least one liquid container loaded on the carriage, above the recording unit, the liquid container storing liquid to be supplied to the recording unit and having a filling port from which liquid can be poured from a refilling container. The liquid container has, at least in one portion thereof, a level checking portion formed of a transparent material through which the liquid level in the liquid container can be viewed. The carriage has a first viewing portion through which the level checking portion of the liquid container can be viewed.

With this configuration, because the carriage has a first viewing portion through which the level checking portion of the liquid container can be viewed, it is possible to check the liquid level of the liquid container loaded on the carriage. In addition, because the liquid container having the level checking portion is provided above the recording unit, and hence, the level checking portion and the first viewing portion are of course located above the recording unit, the eye level of a user who is viewing the liquid level is raised, improving the visibility even more.

It is preferable that the first viewing portion be an opening or a cutaway portion provided in the carriage. With this configuration, the first viewing portion having a simple configuration can be easily formed.

It is preferable that a housing accommodating the carriage and constituting the exterior of the recording apparatus have a second viewing portion through which the level checking portion can be viewed through the first viewing portion.

With this configuration, because the housing accommodating the carriage and constituting the exterior of the recording apparatus has a second viewing portion through which the level checking portion can be viewed through the first viewing portion, it is possible to easily check the liquid level of the liquid container from the outside of the recording apparatus without opening an opening/closing member, such as a cover, to expose the carriage.

It is preferable that the second viewing portion be an opening or a cutaway portion provided in the housing.

With this configuration, the second viewing portion having a simple configuration can be easily formed. In addition, when liquid mist is generated in the housing, the mist can be released to the outside of the recording apparatus through the opening or the cutaway portion. As a result, it is possible to suppress the deposition of the mist on the components inside the recording apparatus, and consequently, to suppress various inconveniences.

It is preferable that the second viewing portion be a window in which an opening is covered with a transparent material through which the level checking portion can be viewed.

With this configuration, because the second viewing portion is a window in which an opening is covered with a transparent material through which the level checking portion can be viewed, entrance of dust or the like into the recording apparatus can be suppressed.

It is preferable that at least a portion of the first viewing portion overlaps the second viewing portion when the carriage is located at a home position.

With this configuration, when the carriage is located at the home position, the liquid level of the liquid container can be checked from the outside of the recording apparatus. For example, if the position of the carriage when the liquid level is checked is set to a position other than the home position, the carriage needs to be moved to that position when the liquid level is checked. This configuration does not require such a step, and it is possible to easily and quickly check the liquid level even when, for example, the recording apparatus is not operating.

It is preferable that the first viewing portion be provided in a front-side surface of the carriage.

With this configuration, because the first viewing portion is provided in a front-side surface of the carriage, the user can easily view the liquid level of the liquid container.

It is preferable that the first viewing portion be provided in a front-side surface of the carriage and that the second viewing portion be provided in a front-side surface of the housing.

With this configuration, because the first viewing portion is provided in a front-side surface of the carriage, and the second viewing portion is provided in a front-side surface of the housing, the user can easily view the liquid level of the liquid container.

It is preferable that the housing have a recess that brings the surface having the second viewing portion closer to the first viewing portion of the carriage in the housing.

With this configuration, because the second viewing portion is brought closer to the first viewing portion, the liquid level of the liquid container can be easily viewed from the second viewing portion.

It is preferable that the recording apparatus further include an upper cover provided in the upper part of the housing, the upper cover opening and closing at least an area in which the carriage moves. The upper cover is formed so as not to cover the upper part of the recess when closed.

With this configuration, because the upper cover does not cover the upper part of the recess when closed, the liquid level of the liquid container can be easily viewed from the second viewing portion.

It is preferable that the housing have an operation panel in the front-side surface thereof and that at least a portion of the second viewing portion be aligned with the operation panel in the height direction of the recording apparatus.

With this configuration, because the operation panel and the second viewing portion are aligned in the height direction, the user can view the operation panel and the second viewing portion at substantially the same eye level. This also improves the appearance of the recording apparatus.

It is preferable that the operation panel include a display portion that indicates the details of the operation and that at least a portion of the second viewing portion be aligned with the display portion in the height direction of the recording apparatus.

With this configuration, because the display portion of the operation panel and the second viewing portion are aligned in the height direction, the user can view the display portion and the second viewing portion at substantially the same eye level. This also improves the appearance of the recording apparatus.

It is preferable that the housing have, in the front-side surface thereof, a discharge portion that discharges a medium after being subjected to recording by the recording unit and that the second viewing portion be located above the discharge portion in the height direction of the recording apparatus.

With this configuration, because the second viewing portion is located above the discharge portion in the height direction of the recording apparatus, the second viewing portion can be disposed at a higher position, and thus, the user can more easily view the second viewing portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
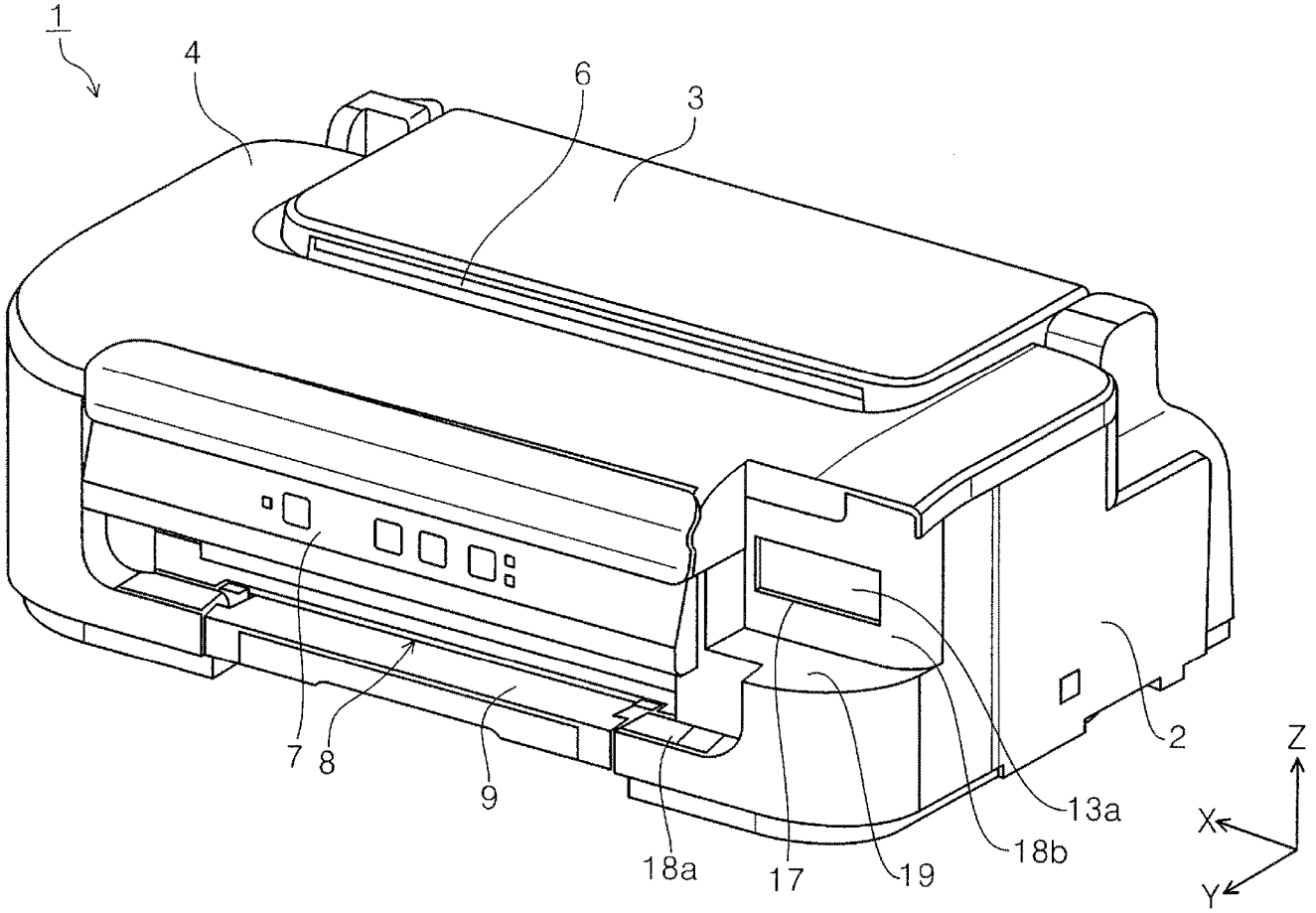
FIG. 1 is an external perspective view of an example printer of the invention.
Figure 2:
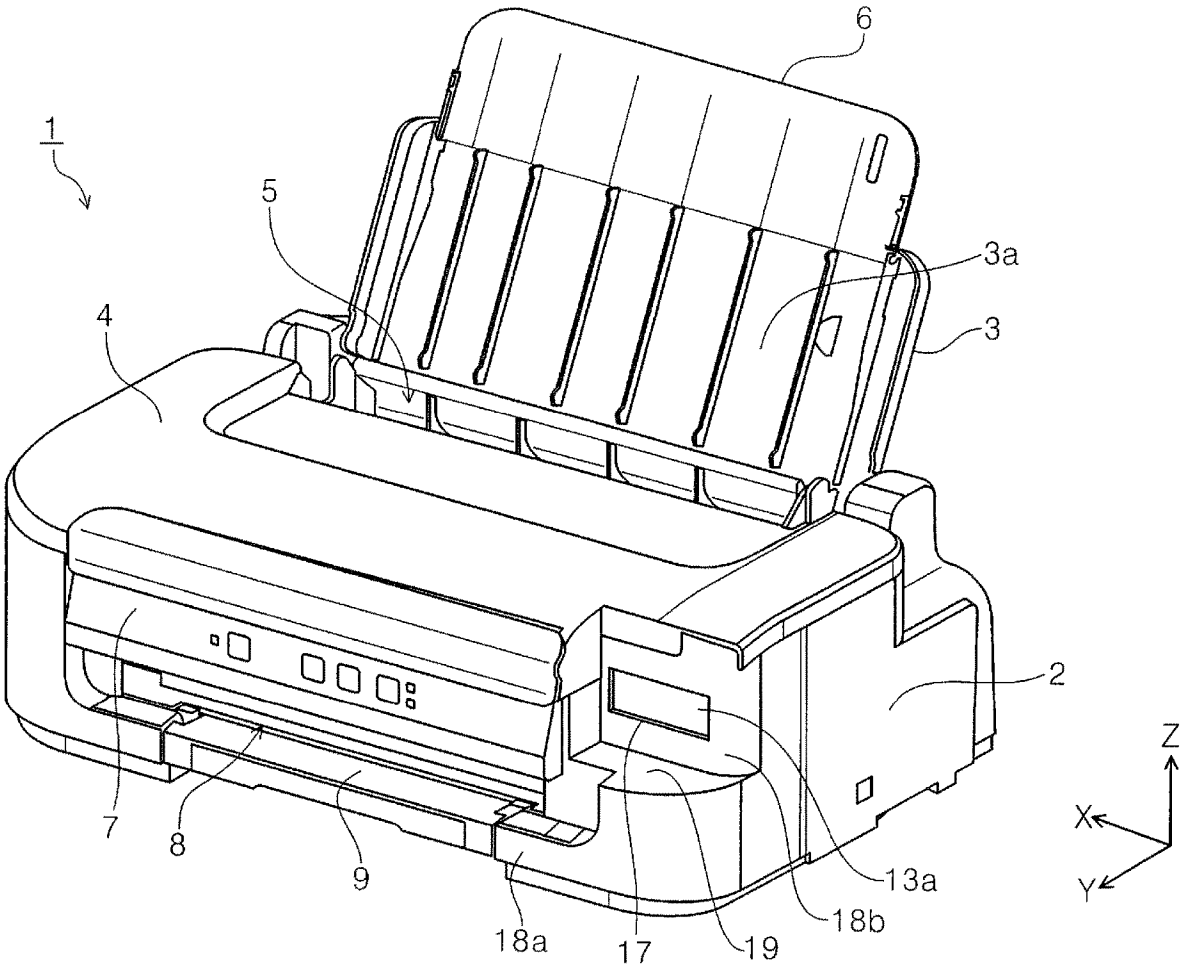
FIG. 2 is a perspective view of the printer shown in FIG. 1 with a paper support open.
Figure 3:
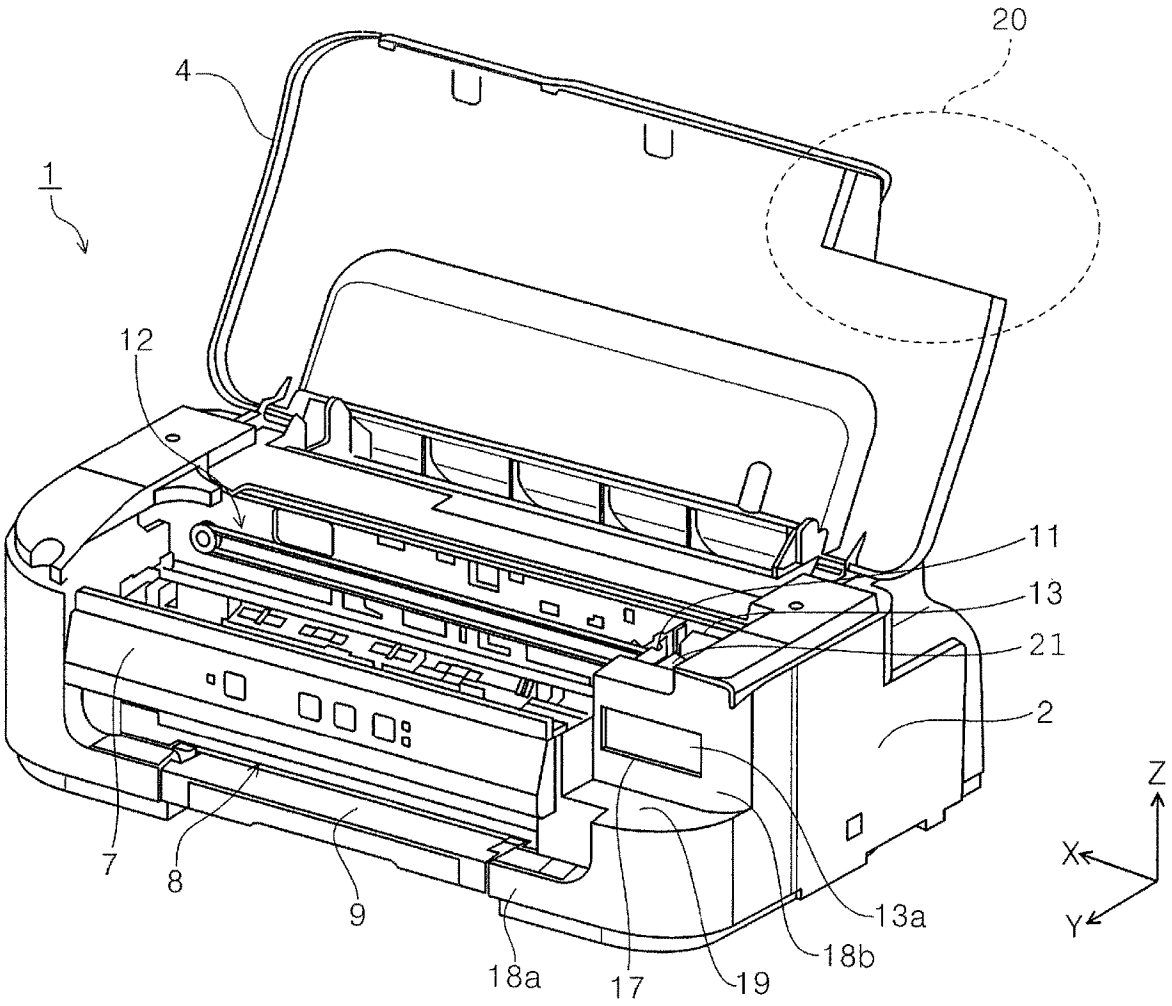
FIG. 3 is a perspective view of the printer shown in FIG. 2 with an upper cover open.
Figure 4:
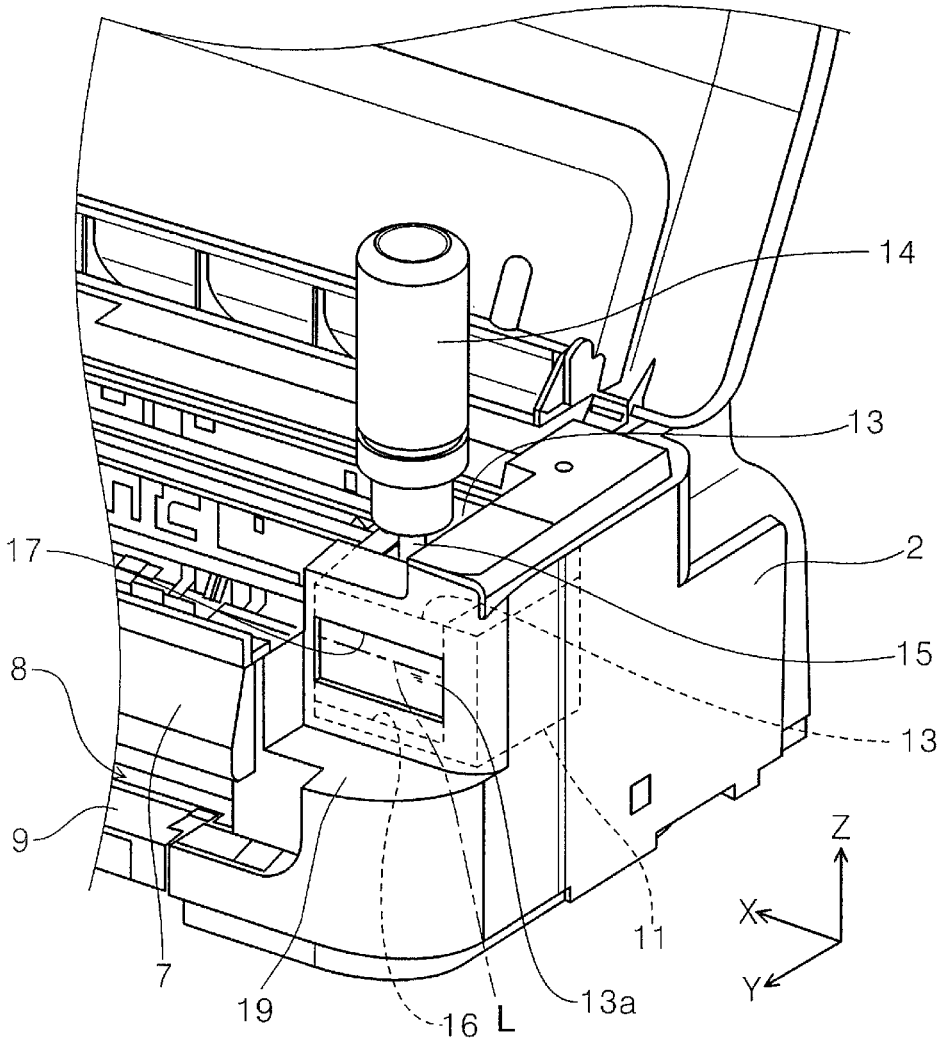
FIG. 4 is a perspective view showing a state in which a refilling container is attached to a filling port in an ink tank.
Figure 5:
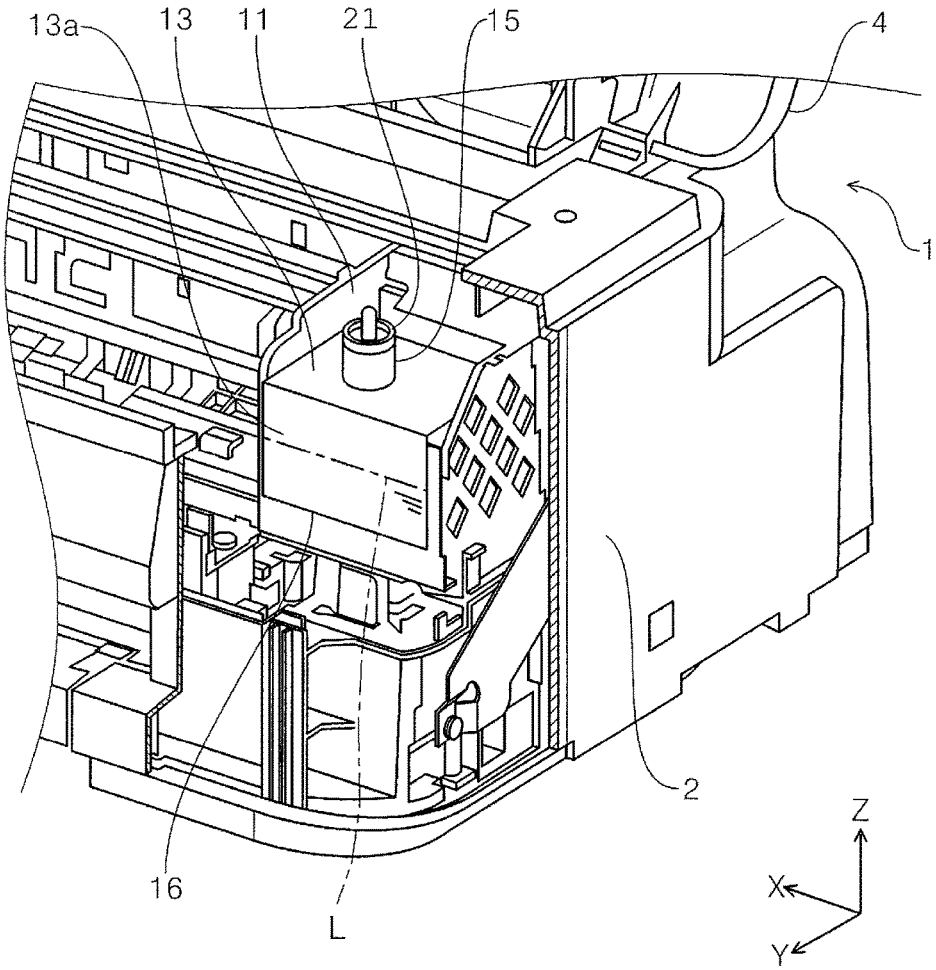
FIG. 5 is an enlarged perspective view of the relevant part shown by partially cutting away a housing.
Figure 6:
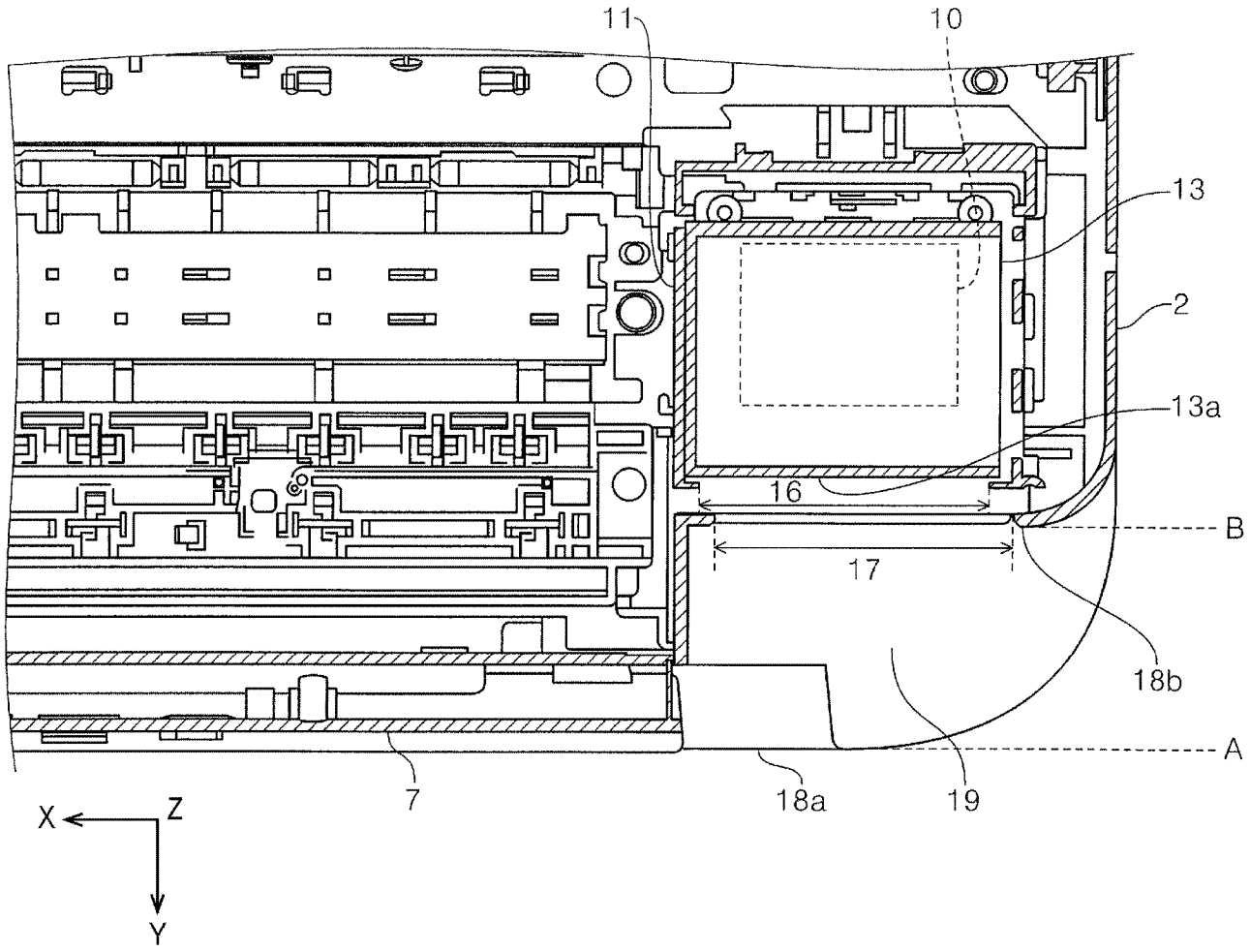
FIG. 6 is an enlarged sectional view of the relevant part of the printer.
Figure 7:
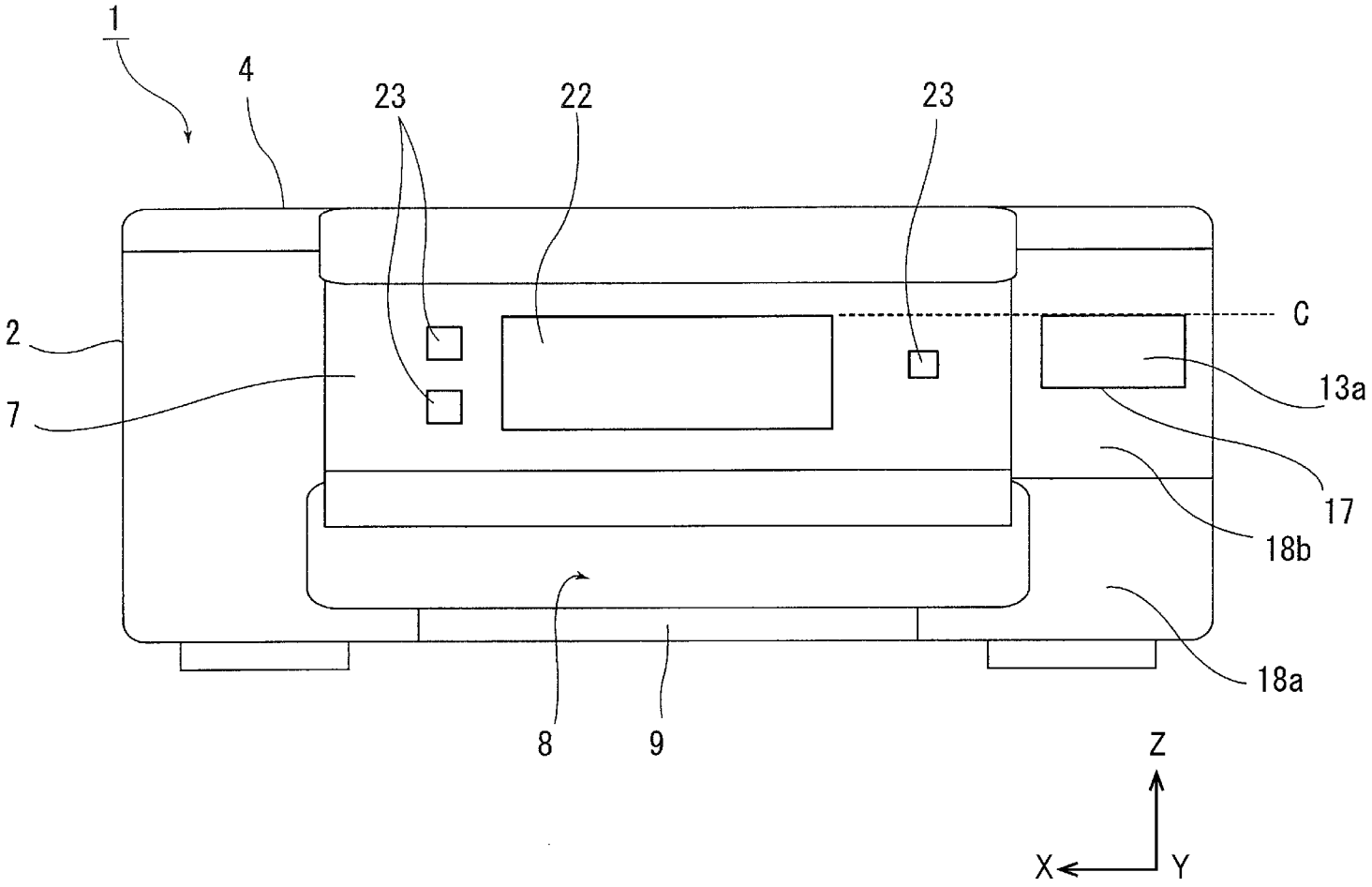
FIG. 7 is a schematic front view showing a modification of the printer.
Figure 8:
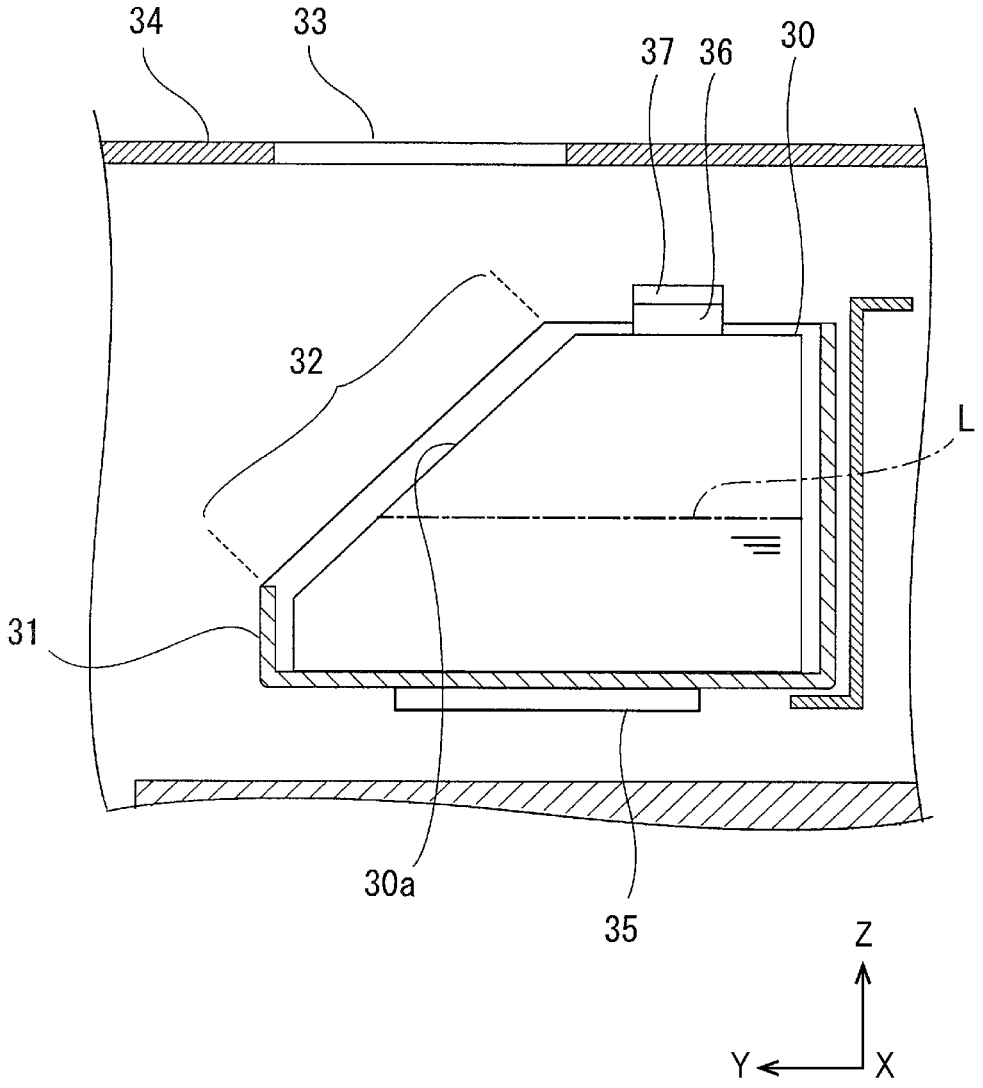
FIG. 8 is a schematic sectional showing the modification of the ink tank.

First, the outline of a recording apparatus according to an embodiment of the invention will be described. In this embodiment, an ink jet printer 1 (hereinbelow, simply, a printer 1), serving as an example of a recording apparatus, will be described. FIG. 1 is an external perspective view of an example printer of the invention. FIG. 2 is a perspective view of the printer shown in FIG. 1 with a paper support open. FIG. 3 is a perspective view of the printer shown in FIG. 2 with an upper cover open. FIG. 4 is a perspective view showing a state in which a refilling container is attached to a filling port in an ink tank. FIG. 5 is an enlarged perspective view of the relevant part shown by partially cutting away a housing. FIG. 6 is an enlarged sectional view of the relevant part of the printer. FIG. 7 is a schematic front view showing a modification of the printer. FIG. 8 is a schematic sectional showing the modification of the ink tank.

In the XYZ coordinate system shown in each drawing, the X direction corresponds to the direction in which the recording head moves, as well as the width direction of the recording apparatus, the Y direction corresponds to the depth direction of the recording apparatus, and the Z direction corresponds to the height direction of the recording apparatus. In each drawing, the +Y direction corresponds to the front-surface side or front side of the recording apparatus, and the −Y direction corresponds to the back-surface side or rear side of the recording apparatus. As viewed from the front-surface side of the recording apparatus, the left side is the +X direction, and the right side is the −X direction. The +Z direction is the upper side of the recording apparatus (including the upper part, the top surface, etc.), and the −Z direction is the lower side of the recording apparatus (including the lower part, the lower surface, etc.).

Overall Configuration of Printer

Referring to FIGS. 1 to 6, the overall configuration of the printer 1 will be described. The exterior of the printer 1 (FIG. 1) is formed of: a housing 2 accommodating a recording head 10 (FIG. 6, described below), serving as a "recording unit", inside thereof; a paper support 3 that has a rotation shaft on the back-surface side of the housing 2 and that is opened and closed; and an upper cover 4 that opens and closes the upper part of the housing 2.

As shown in FIG. 2, when the paper support 3 is opened, a set port 5 provided in the upper part of the housing 2 is exposed. Sheets, serving as "media", are fed to the set port 5. The paper support 3 is a cover for opening and closing the area including the set port 5 in the upper part of the housing 2. As shown in FIG. 2, the paper support 3 forms a slope in an open state and supports the sheets set in the set port 5 with a support surface 3*a*. The paper support 3 has an auxiliary paper support 6 that can be stored in and pulled out from the inside thereof. As shown in FIG. 2, by pulling out the auxiliary paper support 6, longer sheets can be stably supported.

A sheet set in the set port 5 is fed in the +Y direction by a transport device (not shown). Then, recording is performed by the recording head 10 (FIG. 6) in the housing 2, and the sheet after recording is discharged from a discharge portion 8 provided in the front surface of the housing 2.

As shown in FIG. 3, when the upper cover 4 is opened, the inside of the housing 2 is exposed. A carriage 11 having a recording head 10 (FIG. 6) that discharges ink, serving as "liquid", on a sheet to perform recording is provided inside the housing 2. The recording head 10 is provided at the bottom, that is, on the −Z direction side, of the carriage 11 and cannot be viewed in FIG. 3. The carriage 11 is moved in the width direction (X direction) intersecting the medium transport direction (+Y direction) by a belt moving mechanism 12. The upper cover 4 covers the area in which the carriage 11 moves.

The carriage 11 also has an ink tank 13, serving as a "liquid container", that stores ink (liquid) to be supplied to the recording head 10. In this embodiment, although the ink tank 13 is for one color (black color), the carriage 11 may carry a plurality of liquid containers for a plurality of colors. In this embodiment, the ink tank 13 has a filling port 15 via which the ink can be poured from a refilling container 14 (FIG. 4). The filling port 15 is normally closed by a cap 21 (FIGS. 3 and 5). The ink tank 13 can be refilled with ink by removing the cap 21 and attaching the refilling container 14 to the filling port 15, as shown in FIG. 4. The ink tank 13 is configured to allow a user to check the liquid level therein. This feature will be described in detail below.

In this embodiment, the housing 2 has, in the front surface thereof (i.e., the side surface on the front side of the recording apparatus), an operation panel 7 from which operation instructions to the printer 1 are input. The operation panel 7 is provided above the discharge portion 8. The discharge portion 8 has a discharged-sheet tray 9 that can be pulled out.

Configuration for Checking Liquid Level in Ink Tank Level Checking Portion

The ink tank 13 has, at least in a portion thereof, a level checking portion 13*a* (FIG. 5) formed of a transparent material through which the liquid level therein can be viewed. The liquid surface L in the ink tank 13 can be viewed at the level checking portion 13*a*. In this embodiment, the entirety of the ink tank 13, including the level checking portion 13*a* located on the front side thereof (+Y direction side), is formed of a transparent or semitransparent resin material (e.g., a plastic containing polyethylene, polystyrene, or the like). The ink tank 13 may be formed of a non-transparent material, except for the level checking portion 13*a* on the front side thereof, which is formed of a transparent or semitransparent resin material. Although not shown, the level checking portion 13*a* has a lower limit indicator that indicates the ink level, an upper limit indicator that indicates the maximum ink capacity, graduation marks formed therebetween, etc.

First Viewing Portion

The carriage 11 carrying the ink tank 13 has a first viewing portion 16 (FIG. 5) through which the level checking portion 13*a* of the ink tank 13 can be viewed. More specifically, as shown in FIG. 5, the carriage 11 has an open-top box shape, and the ink tank 13 is fitted into the box-shaped carriage 11. The first viewing portion 16 is formed by cutting away a portion of the front-side (+Y-direction-side) surface of the carriage 11.

Because the carriage 11 has the first viewing portion 16, the level checking portion 13*a* can be viewed while the ink tank 13 is loaded on the carriage 11. Furthermore, because the first viewing portion 16 is provided in the front-side surface of the carriage 11, the user can easily view the level checking portion 13*a*. In addition, because the ink tank 13 having the level checking portion 13*a* is provided above the recording head 10 (FIG. 6), the level checking portion 13*a* and the first viewing portion 16 are of course located above the recording head 10. This raises the eye level of the user who is viewing the liquid level, thus improving the visibility even more.

In this embodiment, although the first viewing portion 16 is formed by cutting away a portion of the front-side surface of the carriage 11, it may be formed as, for example, an opening penetrating the side surface. By providing a cut-away portion or an opening in the side surface of the carriage 11, the first viewing portion 16 can be easily formed.

Second Viewing Portion

In the printer 1, the level checking portion 13*a* of the ink tank 13 can also be viewed from the outside of the recording apparatus. More specifically, the housing 2 has a second viewing portion 17 (FIG. 4) through which the level checking portion 13*a* can be viewed through the first viewing portion 16. The second viewing portion 17 is provided as an opening in the housing 2.

In this embodiment, the second viewing portion 17 in the housing 2 is provided such that a portion thereof overlaps the first viewing portion 16 when the carriage 11 is located at the home position (FIGS. 4 and 6). That is, when the carriage 11 is located at the home position, the liquid level of the ink tank 13 can be checked from the outside of the recording apparatus. In this embodiment, the home position of the carriage 11 is set at the right (−X-direction) end in the moving area of the carriage 11, in the front view of the printer 1. FIGS. 3 to 6 show the carriage 11 at the home position.

As described above, because the first viewing portion 16 is provided in the front-side (+Y-direction-side) surface of the carriage 11, the second viewing portion 17 is also provided in a front-side surface 18*b* (FIGS. 1 and 6) of the housing 2.

The second viewing portion 17 provided in the housing 2 provides the following advantages. That is, the liquid level of the ink tank 13 can be easily checked from the outside of the printer 1 without opening the upper cover 4 to expose the carriage 11. Furthermore, in this embodiment, because the second viewing portion 17 is provided in the front-side surface 18*b* (FIG. 1) of the housing 2, the user can easily view the liquid level of the ink tank 13.

If, for example, the position of the carriage 11 when the liquid level is checked is set to a position other than the home position, the carriage 11 needs to be moved to that position when the liquid level is checked. However, in this configuration in which the second viewing portion 17 overlaps the first viewing portion 16 when the carriage 11 is located at the home position, such a step is unnecessary, and thus, the liquid level can be easily and quickly checked even when, for example, the printer 1 is not operating.

In addition, the second viewing portion 17, which is an opening, is easy to form, and, when, for example, ink mist is generated inside the recording apparatus as a result of discharge of ink from the recording head 10, the ink mist can be released to the outside of the recording apparatus through the second viewing portion 17. As a result, it is possible to suppress the deposition of ink mist on the components inside the recording apparatus, and consequently, to suppress various inconveniences.

Other Configurations of Second Viewing Portion

As described above, the second viewing portion 17 is provided in the front-side surface 18*b* (FIGS. 1 and 6). The surface 18*b* is located behind a surface 18*a* (FIGS. 1 and 6) on which the operation panel 7 and the like are provided at the front side of the recording apparatus. As shown in FIG. 6, in the housing 2, the carriage 11 is located slightly away from the front side toward the rear side in the depth direction of the recording apparatus. If the housing 2 has a substantially rectangular shape in plan view, the second viewing portion 17 provided on the front side thereof is provided in the surface 18*a*, together with the operation panel 7 and the like. Thus, the distance between the second viewing portion 17 and the first viewing portion 16 is large.

To counter this problem, the housing 2 has a recess 19 to bring the front-side surface 18*b*, in which the second viewing portion 17 is provided, closer to the first viewing portion 16 of the carriage 11 located inside the housing 2 (FIGS. 1 and 6). By providing the recess 19 in the housing 2, it is possible to provide the second viewing portion 17 in the surface 18*b*, which is located at a position B (FIG. 6) behind a position A (FIG. 6) of the surface 18*a*. This way, the second viewing portion 17 is brought closer to the first viewing portion 16, thus making it easy to view the liquid level of the ink tank 13 from the second viewing portion 17.

Furthermore, in this embodiment, the upper cover 4 in a closed state (FIG. 1) does not cover the upper part of the recess 19. More specifically, the upper cover 4 in a closed state has a cutaway portion (a portion denoted by reference sign 20 in FIG. 3) on the front right side thereof so as not to cover the recess 19 when the printer 1 is viewed from above. It would be natural for a user to view the second viewing portion 17 from the upper front side of the printer 1 when checking the liquid level of the ink tank 13. Hence, this configuration, in which the upper cover 4 does not cover the upper part of the recess 19, makes it easy for the user to check the liquid level from the second viewing portion 17.

Furthermore, in the housing 2 (FIG. 1), at least a portion of the operation panel 7 provided in the front-side surface 18*a* is aligned with the second viewing portion 17 provided in the front-side surface 18*b* in the height direction of the recording apparatus (Z direction). In other words, when the printer 1 is viewed from the front, the operation panel 7 and the second viewing portion 17 are located at substantially the same height. This allows the user to view the operation panel 7 and the second viewing portion 17 at substantially the same eye level and improves the appearance of the recording apparatus.

Furthermore, in this embodiment, in the housing 2, the second viewing portion 17 is located above the discharge portion 8 (FIG. 1). By providing the second viewing portion 17 at a higher position in the printer 1, the user can easily view the level checking portion 13*a* from the second viewing portion 17.

In this embodiment, although the second viewing portion 17 is formed as an opening in the housing 2, it may also be formed as a cutaway portion. Furthermore, the second viewing portion 17 may be formed as a window in which the opening is covered with, for example, a transparent material, such as a transparent plastic or glass, through which the level checking portion 13*a* can be viewed. By covering the second viewing portion 17 with a transparent or semitransparent member, entrance of dust or the like into the housing 2 can be suppressed.

Modification of Printer

Modifications of the components of the printer 1 will be described below.

Operation Panel

As shown in FIG. 7, when the operation panel 7 has a display portion 22 that indicates the details of the operation, it is desirable that at least a portion of the second viewing portion 17 be aligned with the display portion 22 in the height direction of the recording apparatus. In this embodiment, the upper edge of the display portion 22 and the upper edge of the second viewing portion 17 are aligned at the same height C. In FIG. 7, reference sign 23 denotes operation buttons provided on the operation panel 7. Because the second viewing portion 17 and the display portion 22 are aligned in the height direction of the recording apparatus, a user can view the display portion 22 and the second viewing portion 17, which are both the components viewed by the user, at substantially the same eye level. This further improves the appearance of the recording apparatus.

Positions of First Viewing Portion and Second Viewing Portion

The first viewing portion 16 (carriage 11) and the second viewing portion 17 (housing 2) do not necessarily have to be provided on the front side, as shown in FIG. 1, and, for example, the first viewing portion 16 may be provided in the right-side surface of the carriage 11, and the second viewing portion 17 may be provided in the right-side surface of the housing 2. With this configuration, it is possible to check the liquid level in the ink tank 13 from the right-side surface of the recording apparatus when the carriage 11 is located at the home position.

Furthermore, as shown in FIG. 8, it is also possible to configure such that the liquid level in the ink tank is checked from the top-surface side of the recording apparatus. An ink tank 30 shown in FIG. 8 has an inclined surface on the front side (+Y direction side), which serves as a level checking portion 30*a*. A carriage 31 having a recording head 35 on the bottom has a first viewing portion 32 through which the level checking portion 30*a* can be viewed. An upper cover 34, which opens and closes the area in which the carriage 31 moves, has, in a portion above the first viewing portion 32, a second viewing portion 33 through which the level checking portion 30*a* can be viewed through the first viewing portion 32. By viewing the second viewing portion 33 from above, a user can view the position of the liquid surface L through the inclined level checking portion 30*a*, and thus, can check the ink level in the ink tank 30. In FIG. 8, reference sign 36 denotes a filling port, and reference sign 37 denotes a cap for the filling port 36.

In this embodiment, although the level checking portion 13*a* has a lower limit indicator that indicates the ink level, an upper limit indicator that indicates the maximum ink capacity, graduation marks formed therebetween, etc., at least one of them may be provided.

Although exemplary embodiments of the invention have been described above, the invention is not limited thereto and may be variously modified within the scope of the invention described in the claims, and such modifications are of course included in the scope of the invention.

The entire disclosure of Japanese Patent Application No. 2017-061399, filed Mar. 27, 2017 is expressly incorporated by reference herein.

What is claimed is:

1. A recording apparatus comprising:

a recording unit that discharges liquid on a medium to perform recording;

a carriage that has the recording unit on the bottom and is movable in a width direction intersecting a medium transport direction;

a housing accommodating the carriage and constituting the exterior of the recording apparatus, and at least one liquid container loaded on the carriage, above the recording unit, the liquid container storing liquid to be supplied to the recording unit and having a filling port from which liquid can be poured from a refilling container, wherein the liquid container has, at least in one portion thereof, a level checking portion formed of a transparent material through which the liquid level in the liquid container can be viewed, the carriage has a first viewing portion through which the level checking portion of the liquid container can be viewed, and the housing has a second viewing portion through which the level checking portion can be viewed through the second viewing portion and the first viewing portion even when any covers of the housing are in a closed position.

2. The recording apparatus according to claim 1, wherein the first viewing portion is an opening or a cutaway portion provided in the carriage.

3. The recording apparatus according to claim 1, wherein the second viewing portion is an opening or a cutaway portion provided in the housing.

4. The recording apparatus according to claim 1, wherein the second viewing portion is a window in which an opening is covered with a transparent material through which the level checking portion can be viewed.

5. The recording apparatus according to claim 1, wherein at least a portion of the first viewing portion overlaps the second viewing portion when the carriage is located at a home position.

6. The recording apparatus according to claim 1, wherein the first viewing portion is provided in a front-side surface of the carriage.

7. The recording apparatus according to claim 1, wherein the first viewing portion is provided in a front-side surface of the carriage, and the second viewing portion is provided in a front-side surface of the housing.

8. The recording apparatus according to claim 7, wherein the housing has an operation panel in the front-side surface thereof, and at least a portion of the second viewing portion is aligned with the operation panel in the height direction of the recording apparatus.

9. The recording apparatus according to claim 8, wherein the operation panel includes a display portion that indicates the details of the operation, and at least a portion of the second viewing portion is aligned with the display portion in the height direction of the recording apparatus.

10. The recording apparatus according to claim 7, wherein the housing has, in the front-side surface thereof, a discharge portion that discharges a medium after being subjected to recording by the recording unit, and the second viewing portion is located above the discharge portion in the height direction of the recording apparatus.

11. The recording apparatus according to claim 1, wherein the level checking portion has at least one of an upper limit indicator and a lower limit indicator that indicate the amount of liquid.

12. A recording apparatus comprising:

a recording unit that discharges liquid on a medium to perform recording;

a carriage that has the recording unit on the bottom and is movable in a width direction intersecting a medium transport direction;

a housing accommodating the carriage and constituting the exterior of the recording apparatus; and at least one liquid container loaded on the carriage, above the recording unit, the liquid container storing liquid to be supplied to the recording unit and having a filling port from which liquid can be poured from a refilling container, wherein the liquid container has, at least in one portion thereof, a level checking portion formed of a transparent material through which the liquid level in the liquid container can be viewed, the carriage has a first viewing portion through which the level checking portion of the liquid container can be viewed, and the housing has a second viewing portion through which the level checking portion can be viewed through the first viewing portion even when any covers of the housing are in a closed position, wherein the first viewing portion is provided in a front-side surface of the carriage, the second viewing portion is provided in a front-side surface of the housing, and, the housing has a recess that brings the surface having the second viewing portion closer to the first viewing portion of the carriage in the housing.

13. The recording apparatus according to claim 12, further comprising an upper cover provided in the upper part of the housing, the upper cover opening and closing at least an area in which the carriage moves, wherein the upper cover is formed so as not to cover the upper part of the recess when closed.

* * * * *